US007541796B2

(12) United States Patent
Imtiaz

(10) Patent No.: US 7,541,796 B2
(45) Date of Patent: Jun. 2, 2009

(54) MOSFET TRIGGERED CURRENT BOOSTING TECHNIQUE FOR POWER DEVICES

(75) Inventor: S. M. Sohel Imtiaz, San Jose, CA (US)

(73) Assignee: Micrel, Incorporated, San Jose, CA (US)

( * ) Notice: Subject to any disclaimer, the term of this patent is extended or adjusted under 35 U.S.C. 154(b) by 421 days.

(21) Appl. No.: 11/176,609

(22) Filed: Jul. 6, 2005

(65) Prior Publication Data

US 2007/0007934 A1 Jan. 11, 2007

(51) Int. Cl.
*G05F 3/16* (2006.01)

(52) U.S. Cl. ..... 323/313; 323/280

(58) Field of Classification Search ..... 323/312, 323/313, 314, 315, 316, 280; 327/543
See application file for complete search history.

(56) References Cited

U.S. PATENT DOCUMENTS 4,963,837 A * 10/1990 Dedic ..... 330/264
5,955,915 A * 9/1999 Edwards ..... 323/313
6,479,975 B1 * 11/2002 Plankensteiner et al. .... 323/313
7,142,046 B1 * 11/2006 Elbanhawy ..... 327/543

OTHER PUBLICATIONS

Rincon-Mora et al: "A Low-Voltage, Low Quiescent Current, Low Drop-Out Regulator", IEEE Journal of Solid-State Curcuits, vol. 33, No. 1, Jan. 1998, pp. 36-44.
S. M. Sze: "Physics of Semiconductor Devices", Physics and Properties of Semiconductors-A Resume, Wiley, 2nd Edition, pp. 32.
Jacob Baker: "CMOS Circuit Design, Layout and Simulation", Wiley, 2nd Edition, pp. 636-637.

* cited by examiner

*Primary Examiner*—Jessica Han
(74) *Attorney, Agent, or Firm*—Bever, Hoffman & Harms, LLP; Jeanette S. Harms

(57) ABSTRACT

A voltage regulator output stage can include a power device whose body to source junction is forward biased using a MOSFET trigger. The forward biasing can advantageously reduce the threshold voltage of the power device, thereby effectively increasing its gate drive as well as its output current capability. Controlling the forward biasing using the MOSFET trigger provides minimal leakage, thereby ensuring that the output stage is commercially viable as well as performance enhanced.

11 Claims, 9 Drawing Sheets

MOSFET TRIGGERED CURRENT BOOSTING TECHNIQUE FOR POWER DEVICES

BACKGROUND OF THE INVENTION

1. Field of the Invention

The present invention relates to a voltage regulator and in particular to an output stage of a voltage regulator that can increase its current without adverse impact on circuit operation, cost, or battery life.

2. Related Art

Portable electronic devices, such as laptops and wireless communication devices, have increasingly sophisticated functionality with longer battery life and/or longer time between charges. A low dropout (LDO) regulator is frequently used in such portable electronic devices. In general, a voltage regulator can reduce an input voltage, thereby providing a regulated output voltage. LDO regulators can advantageously provide a significantly smaller minimum required voltage between the input/output voltages, i.e. the dropout voltage, than standard voltage regulators. The dropout voltage has a direct relationship to the battery life of the device. Specifically, the smaller the dropout voltage of the LDO regulator, the longer the battery life.

FIG. 1A illustrates a conventional LDO regulator 100. In LDO regulator 100, an error amplifier 101 provides its output to a gate buffer 109, which in turns provides its output to the gate of a pass (PMOS) transistor 102. Pass transistor 102 has its source connected to voltage source VDD (also called Vin) and its drain connected to a node 103 that provides voltage VOUT (which drives a load 107). Note that although shown schematically as a single transistor, pass transistor 102 typically includes many transistors, e.g. on the order of thousands of transistors, and therefore is also called a "power device" in the industry. Resistors 104 and 106 are connected in series between node 103 and a voltage source VSS. A node 105, which is located between resistors 104 and 106, provides a feedback voltage to the positive input terminal of error amplifier 101. A reference voltage Vref, which is typically generated by a bandgap circuit, is provided to the negative input terminal of error amplifier 101. In this configuration, pass transistor (hereinafter, power device) 102 can provide a relatively low dropout voltage, e.g. 60 mV compared to 2 V for standard regulators.

FIG. 1B illustrates an improved LDO regulator 110 that can improve gate drive without increasing input voltage or device size. Specifically, improved LDO regulator 110 can forward bias the body to source junction of power device 102. This forward biasing can advantageously reduce the threshold voltage of power device 102, thereby effectively increasing its gate drive as well as its output current capability. In other words, for the same gate bias, more current can flow through power device 102 when it is forward biased.

Notably, the forward biased junction of power device 102 is defined by the voltage drop across Schottky diode 111, which has its anode connected to voltage source VDD. In LDO regulator 110, a PMOS transistor 112 and NMOS transistors 113 and 114 can form a bias circuit that limits the current through Schottky diode 111. In this embodiment, the gate of PMOS transistor 112 can receive an output of error amplifier 101, its source can be connected to voltage source VDD, and its body can be forward biased. The drain of PMOS transistor 112 can be connected to the drain and gate of NMOS transistor 113. The sources of NMOS transistors 113 and 114 are connected to voltage source VSS, the gate of NMOS transistor 114 is connected to the gate of NMOS transistor 113, and the drain of NMOS transistor 114 is connected to the cathode of Schottky diode 111. Because NMOS transistors 113 and 114 form a current mirror in this configuration, the current through PMOS transistor 112 can determine the current through Schottky diode 111 by controlling its forward bias.

Note that PMOS transistor 112 has a defined relationship to power device 102, i.e. the sizing and construction of PMOS transistor 112 is substantially identical to a constituent transistor of power device 102. Therefore, a current through PMOS transistor 112 should be substantially proportional to the current through power device 102.

Unfortunately, an actual implementation of LDO regulator 110 has significant disadvantages. Specifically, Schottky diodes are infrequently used in the industry and therefore undesirably increase the cost of the implemented circuits. Moreover, even if available, Schottky diodes have a high leakage current, e.g. increasing ground current by as much as 360%. A high leakage current can significantly reduce battery life in portable applications. Therefore, LDO regulator 110 including Schottky diode 111 would not be a commercially viable implementation.

Therefore, a need arises for an output stage of a voltage regulator that can increase the current of the power device without adverse impact on circuit operation, cost, or battery life.

SUMMARY OF THE INVENTION

In accordance with one aspect of the invention, a voltage regulator output stage can include a power device that is forward biased using a MOSFET trigger. The forward biasing can advantageously reduce the threshold voltage of the power device, thereby effectively increasing its gate drive as well as its output current capability. Controlling the forward biasing using the MOSFET trigger provides minimal leakage, thereby ensuring that the output stage is commercially viable as well as performance enhanced.

In the output stage, a sense device can be provided to track the operation of the power device. In one implementation, the power device can have a source connected to a first voltage source (e.g. VDD), a gate receiving a gate bias (e.g. VGATE), and a drain connected to an output of the regulator output stage (e.g. VOUT). The sense device can have a source connected to a node, a gate receiving the gate bias, and a drain connected to the output. Notably, this node can be connected to the first voltage source through a resistor and further connected to a current limit circuit. In this configuration, the node can detect the current through the sense device and, correspondingly, the power device. In accordance with one aspect of the invention, if a current limit condition occurs in the power device, then the current limit circuit can generate the gate bias.

In one embodiment, a triggering device can be connected between the first voltage source and the bodies of the power device and the sense device, thereby forward biasing the power and sense devices when the triggering device is conducting. A bias circuit can advantageously set the current through the triggering device (e.g. to 1-2 μamps). The triggering device can be an NMOS transistor having a drain, a gate, and a body connected to the first voltage source, and a source connected to the bodies of the power device and the sense device. Alternatively, the triggering device can be an NMOS transistor (e.g. a standard MOSFET or a substrate NMOS transistor) having a drain and a gate connected to the first voltage source, and a source and a body connected to the bodies of the power device and the sense device. In yet another embodiment, the triggering device can be a PMOS transistor having a source and a body connected to the first voltage source, a drain connected to the bodies of the power device and the sense device, and a gate for receiving the gate bias.

In one exemplary implementation, the regulator output stage can include three PMOS transistors, two NMOS transistors, and a triggering transistor. A first PMOS transistor can have a gate connected to a gate bias line, a source connected to a first voltage source, and a drain connected to an output terminal. A second PMOS transistor can have a gate connected to the gate bias line, a source connected to a current sense line as well as to the first voltage source through a resistor, and a drain connected to the output terminal. A third PMOS transistor can have a gate connected to the gate bias line, a source connected to the first voltage source, and a drain. A first NMOS transistor can have a drain and a gate connected to the drain of the third PMOS transistor, and a source connected to a second voltage source. A second NMOS transistor can have a gate connected to the gate of the first NMOS transistor, a source connected to a second voltage source, and a drain. The triggering transistor can be connected between the first voltage source and bodies of the first, second, and third PMOS transistors.

In one embodiment, the triggering transistor can be an NMOS transistor having a drain, a gate, and a body connected to the first voltage source, and a source connected to the bodies of the first, second, and third PMOS transistors. In another embodiment, the triggering transistor can be an NMOS transistor having a drain and a gate connected to the first voltage source, and a source and a body connected to the bodies of the first, second, and third PMOS transistors. Note that this NMOS transistor could be implemented as a substrate NMOS transistor. In yet another embodiment, the triggering transistor can be a PMOS transistor having a source and a body connected to the first voltage source, a source connected to the bodies of the first, second, and third PMOS transistors, and a gate connected to the gate bias line.

In accordance with another aspect of the invention, a method of operating an output stage of a voltage regulator includes forward biasing the body to source junction of a power device and a sense device. Notably, a current sensing signal of the output stage can be used to affect a gate bias of the power device and the sense device. Specifically, if a current limit condition occurs, then the current limit circuit, which receives the current sensing signal, can generate the gate bias.

DETAILED DESCRIPTION OF THE FIGURES

Forward biasing the body to source junction of a power device in a voltage regulator can provide significant performance advantages. Specifically, forward biasing the body to source junction can significantly reduce the threshold voltage of that power device, thereby effectively increasing its gate drive as well as its output current capability. In other words, for the same gate bias, more current can flow through the power device when it is forward biased.

This forward bias can be defined by a voltage drop across a Schottky diode, which has significant disadvantages. Specifically, Schottky diodes are infrequently used in the industry and therefore undesirably increase the cost of the implemented circuits. Moreover, even if available, Schottky diodes have a high leakage current, which can significantly reduce battery life in portable applications. Therefore, voltage regulators including Schottky diodes are generally not considered commercially viable implementations.

Figure 2A:
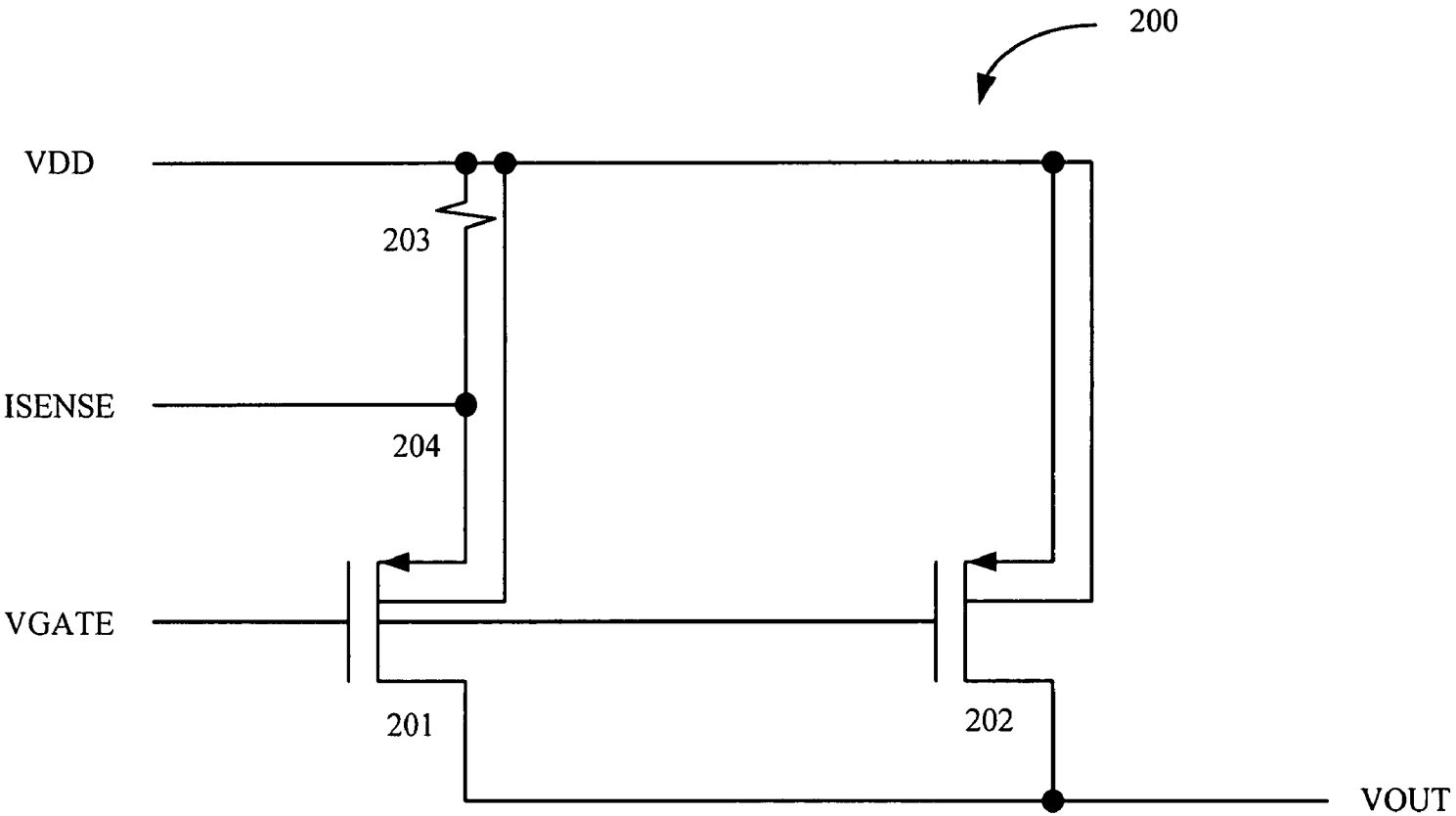
FIG. 2A illustrates a simplified output stage of a voltage regulator in which the body to source junction of the power device can be forward biased without use of the Schottky diode.

In accordance with one aspect of the invention, an output stage of a voltage regulator can increase the current of the power device without adverse impact on circuit operation, cost, or battery life. For example, FIG. 2A illustrates a simplified voltage regulator output stage 200 that includes a sense device 201 and a power device 202. In one embodiment, these devices can be implemented as PMOS transistors with their bodies connected to voltage source VDD, their gates receiving a gate bias VGATE, and their drains connected to a VOUT pin. Gate bias VGATE can be an output of a gate buffer during normal operation or an output of a current limit circuit during a current limit condition. Note that sense device 201 has a defined relationship to power device 202, i.e. the sizing and construction of sense device 201 is substantially identical to a constituent transistor of power device 202. Therefore, a current through sense device 201 should be substantially proportional to the current through power device 202.

In output stage 200, power device 202 has its source connected to voltage source VDD, whereas sense device 201 has its source dually connected to voltage source VDD through a resistor 203 as well as to a current limit circuit (described in reference to FIG. 2B) via a line ISENSE. In one embodiment, resistor 203 can have a resistance of approximately 2 Ohm.

In the configuration of output stage 200, the load connected to the VOUT pin can affect the current through power device 202 and thus can also affect the current through sense device 201 as well as the voltage at node 204. In accordance with one aspect of the invention, the voltage at node 204 can in turn affect the gate bias voltage VGATE. Specifically, as the load (see, for example, load 107 in FIG. 1) increases at VOUT, the current on line ISENSE (i.e. at node 204) increases. The increased current at node 204 means that the voltage drop across resistor 203 will also increase. The current limit circuit, which is connected to node 204, can be activated based on a predetermined voltage drop.

Figure 2B:
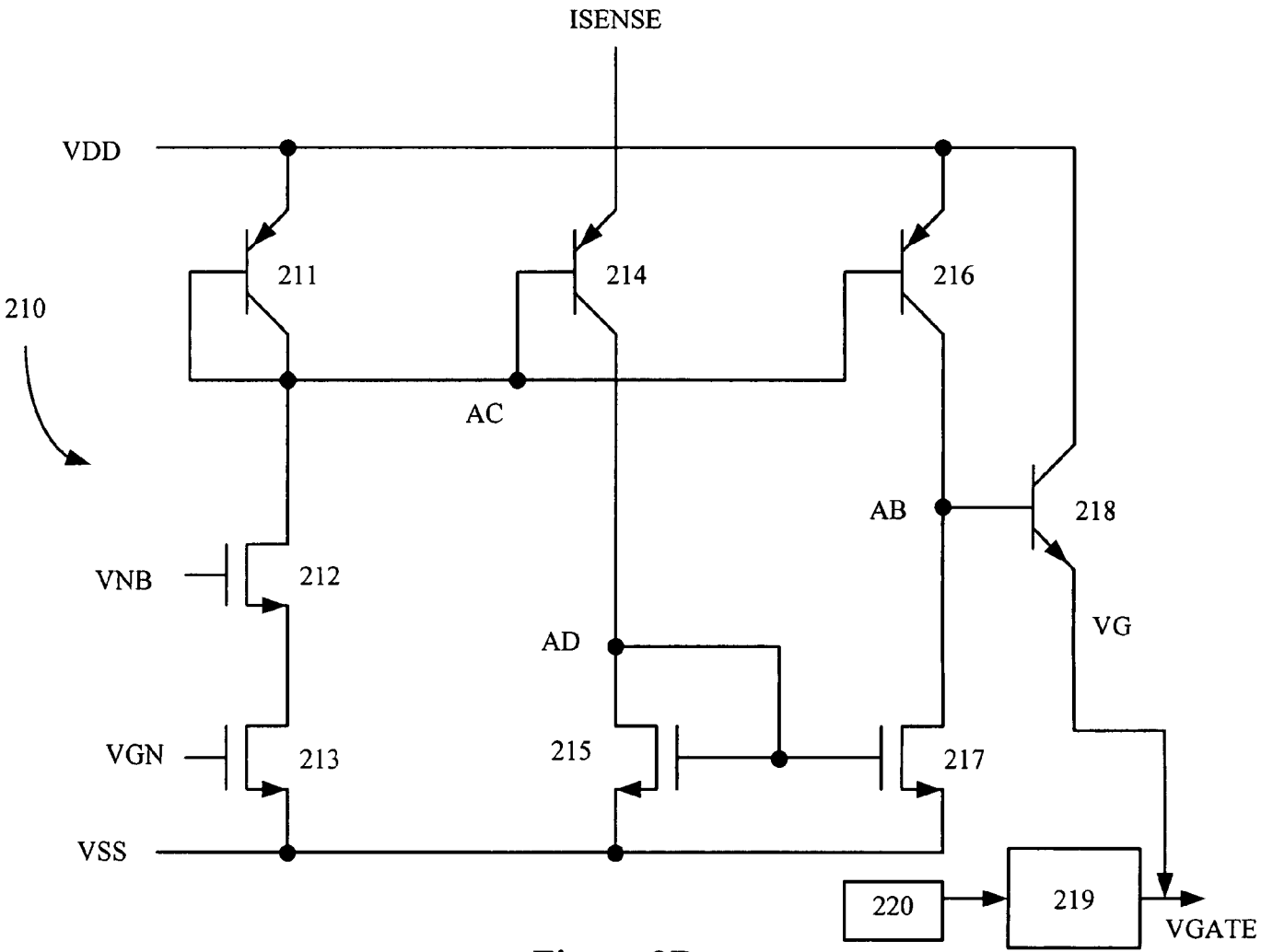
FIG. 2B illustrates an exemplary current limit circuit.

FIG. 2B illustrates an exemplary current limit circuit 210 including line ISENSE. This embodiment of current limit circuit 210 can include both PNP and NMOS transistors. Specifically, a PNP transistor 211 has its emitter connected to voltage source VDD and its base and collector connected to node AC. A PNP transistor 214 has its emitter connected to line ISENSE, its base connected to node AC and its collector connected to node AD. A PNP transistor 216 has its emitter connected to voltage source VDD, its base connected to node AC, and its drain connected to node AB.

NMOS transistors 212 and 213 can be serially connected between the collector of PNP transistor 211 and voltage source VSS. NMOS transistors 215 and 217 can be connected between nodes AD and AB, respectively, and voltage source VSS. The gates of NMOS transistors 215 and 217 are connected to node AD. An NPN transistor 218 has its collector connected to voltage source VDD, its base connected to node AB, and its emitter providing voltage VG. Note that in this configuration, the base-emitter voltage (VBE) of PNP transistor 214 is lowered by the voltage drop across resistor 203 (FIG. 2A).

If current limit circuit 210 is enabled, then the gates of NMOS transistors 212 and 213 receive bias voltages VNB and VGN, respectively, which weakly turn on those transistors. Note that these two transistors can generate a constant current, which in turn ensures that the base to emitter voltage ($V_{BE}$) of PNP transistor 211 is constant with respect to any change in the voltage source VDD. The use of two transistors in an exemplary cascode current mirror is described in detail in "CMOS Circuit Design, Layout, and Simulation", pages 636-637, by R. Jacob Baker, published by Wiley-IEEE Press, $2^{nd}$ edition, 2004. The low voltage transferred by NMOS transistors 212 and 213 turns on PNP transistors 211, 214, and 216. Of importance, PNP transistor 214 is twice the size of PNP transistors 211 and 216. Thus, if PNP transistors 211, 214, and 216 are conducting, then the current through PNP transistor 214 is 2*x* the current through PNP transistors 211 and 216.

During normal operation, a low current is provided on line ISENSE. Thus, a relatively high voltage is provided on line ISENSE. For example, if VDD=4 V, then the voltage on line ISENSE could be approximately 3.995 V. This relatively high voltage can be transferred to the gates of NMOS transistors 215 and 217, thereby turning on those transistors. In the configuration of current limit circuit 210, the current through PNP transistor 214 would be the same through NMOS transistor 215 as well as NMOS transistor 217 (which forms a current mirror with NMOS transistor 215). Therefore, even though both PNP transistor 216 and NMOS transistor 217 are conducting, more current is flowing through NMOS transistor 217, thereby pulling down the voltage at node AB. The low voltage at node AB turns off NPN transistor 218. In this case, current limit circuit 210 can be characterized as inactive.

During a current limit condition, the base-emitter voltage of PNP transistor 214 is reduced, thereby reducing the current through that transistor. Specifically, PNP transistor 214 has the voltage on line ISENSE as its emitter voltage rather than VDD. Thus, when the voltage drop across resistor 203 (FIG. 2A) increases to a predetermined value (e.g. 20 mV) during a current limit condition (i.e. VOUT=0), the current through PNP transistor 214, and thus also through NMOS transistor 217, is less than the current through PNP 216. Because more current is flowing through PNP transistor 216 than NMOS transistor 217, the voltage on node AB is pulled up (e.g. to 2.7 V if VDD=4 V). This relatively high voltage turns on NPN transistor 218, thereby providing a voltage on the order of 0.7 V lower than the voltage at node AB (e.g. 2.0 V). In this case, current limit circuit 210 can be characterized as active.

In one embodiment, the output of current limit circuit 210, i.e. voltage VG, can be connected to the output of a gate buffer 219. Gate buffer 219 can be used to provide higher current gain or provide a voltage shift for driving the power device. In this embodiment, gate buffer 219 receives an output of an error amplifier 220. Note that the output of gate buffer 219 is connected to the gate of the power device as well as the output of current limit circuit 210. During normal operation, gate buffer 219 can provide the desired manipulation of the output of error amplifier 220, wherein that manipulated signal is then provided as VGATE. However, during a current limit condition, gate buffer 219 can be passive, thereby allowing VG from current limit circuit 210 to be provided as VGATE.

Figure 3:
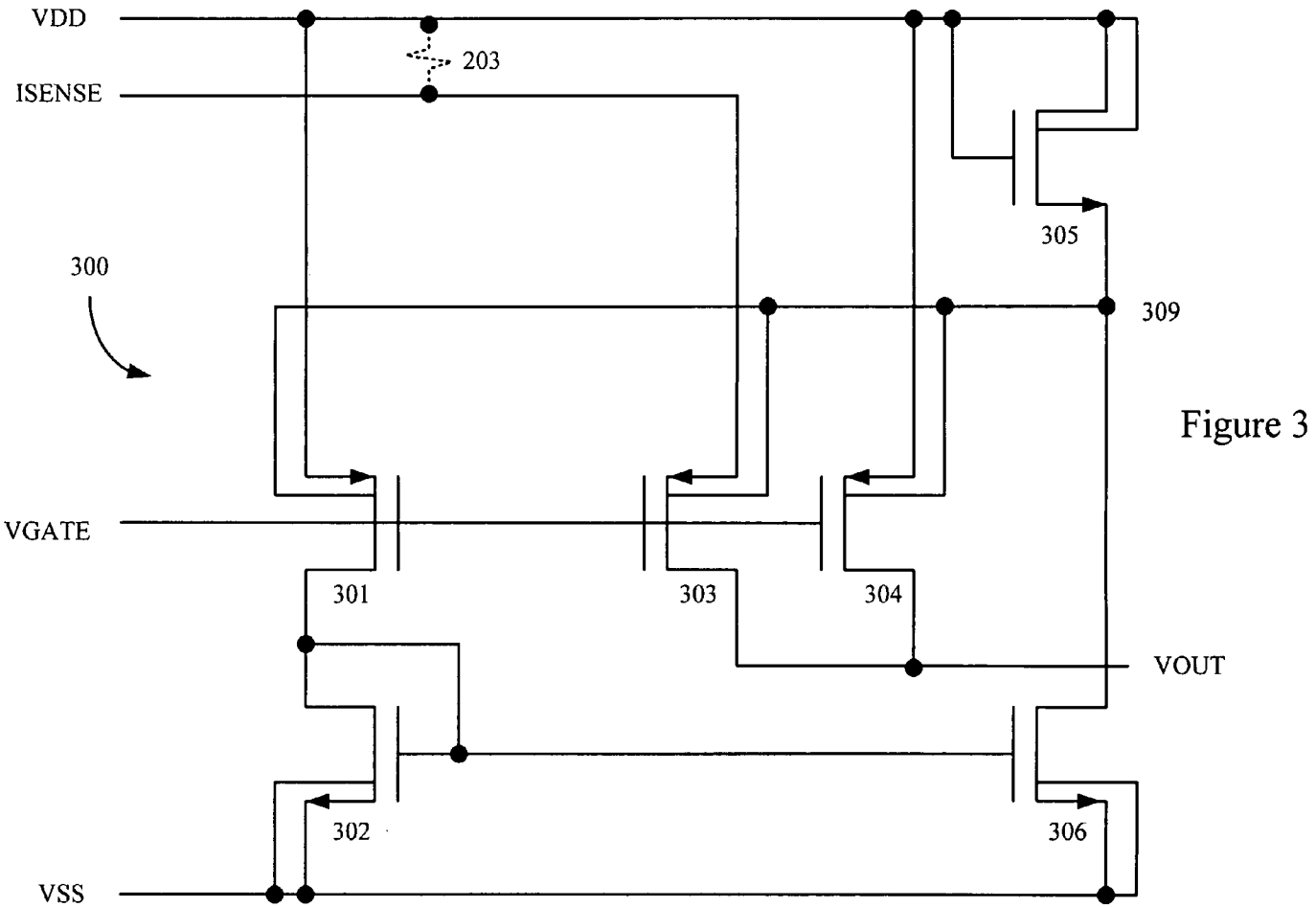
FIGS. 3-5 illustrate various embodiments for output stages of a voltage regulator, wherein each output stage includes a triggering device. These implementations can provide improved circuit operation, cost, and battery life compared to the output stages in standard regulators.

FIG. 3 illustrates an exemplary regulator output stage 300 that includes a triggering device 305, which advantageously controls the forward biasing. In output stage 300, the source of a PMOS transistor 304 is connected to voltage source VDD whereas the source of a PMOS transistor 303 is connected to line ISENSE, which is connected to a current limit circuit (e.g. current limit circuit 210 of FIG. 2B) as well as to voltage source VDD via a resistor (e.g. resistor 203, shown for reference). Each of PMOS transistors 303 and 304 receives gate bias VGATE on its gate and has a drain connected to VOUT. In this configuration, PMOS transistor 304 can function as (and hereinafter will be called) a power device and PMOS transistor 303 can function as (and hereinafter will be called) a sense device. Specifically, sense device 303 and power device 304 can function similarly to sense device 201 and power device 202 (FIG. 2A).

Notably, the bodies of power device 304 and sense device 303 can be connected to a trigger point 309. A triggering device 305 is connected between voltage source VDD and trigger point 309. As explained in further detail below, triggering device 305 and a bias circuit can advantageously be used to control the forward biasing of power device 304 (and sense device 303).

Figure 1A:
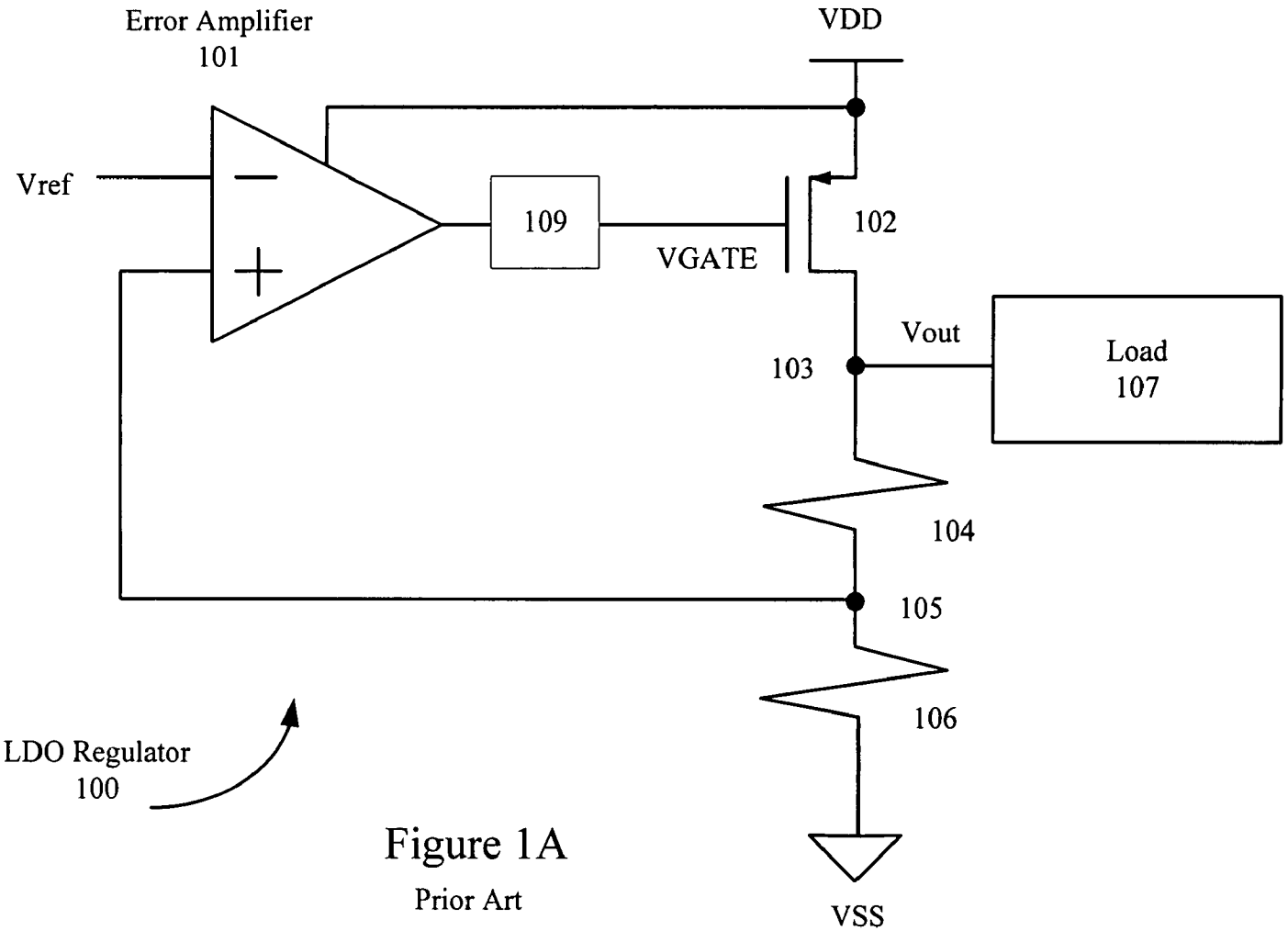
Figure 1A Prior Art
FIG. 1A illustrates a simple LDO regulator having a power device in its output stage.
Figure 1B:
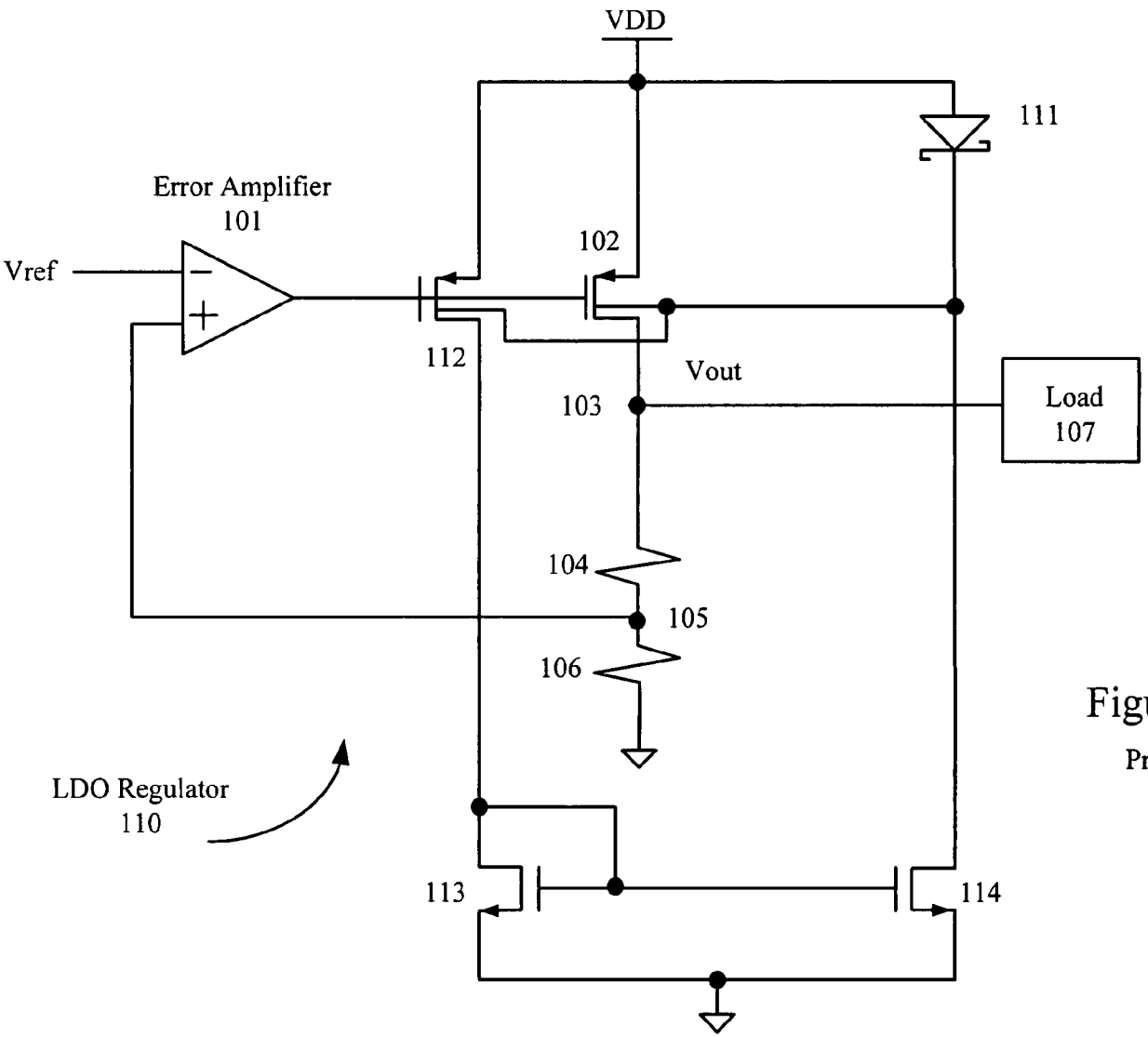
Figure 1B Prior Art
FIG. 1B illustrates another known LDO regulator that forward biases the body to source junction of the power device using a Schottky diode.

In output stage 300, a PMOS transistor 301 along with NMOS transistors 302 and 306 can function as a bias circuit. These transistors are configured and function similarly to transistors 112, 113, and 114 (FIG. 1). Specifically, the drain and gate of NMOS transistor 302 as well as the gate of NMOS transistor 306 are connected to the drain of PMOS transistor 301. The bodies and sources of NMOS transistors 302 and 306 are connected to a voltage source VSS. The drain of NMOS transistor 306 is connected to trigger node 309. In this configuration, transistors 301, 302, and 306 can set the biasing current of triggering device 305 such that triggering device 305 is barely conducting (i.e. passing only a small current of, for example, 1-2 μamp). Note that the current through triggering device 305 and NMOS transistor 306 is mirrored in PMOS transistor 301 and NMOS transistor 302.

In this embodiment, triggering device 305 is implemented as an NMOS transistor that has its source connected to trigger node 309 and its gate, drain, and body connected to voltage source VDD. Thus, the body to source junction of triggering device 305 is also forward biased, e.g. to provide a threshold voltage of approximately 0.3 V to 0.5 V. In one embodiment, triggering device 305 can be manufactured as an isolation device with isolation rings surrounding it, thereby further minimizing any leakage current. When triggering device 305 turns on, the voltage at trigger node 309 is lowered by the threshold voltage of triggering device 305.

Because trigger node 309 is connected to the bodies of power device 304 and sense device 303, their body to source junctions are advantageously forward biased, thereby reducing the "on" resistance ($R_{dson}$) of those devices. Therefore, for the same gate bias, the current through power device 304 (and also through sense device 303, which tracks power device 304) is higher when forward biasing is provided. Notably, this higher current can advantageously lower the dropout voltage. Moreover, because triggering device 305 is implemented as a MOSFET transistor rather than as a Schottky diode, output stage 300 has minimal leakage.

Figure 4:
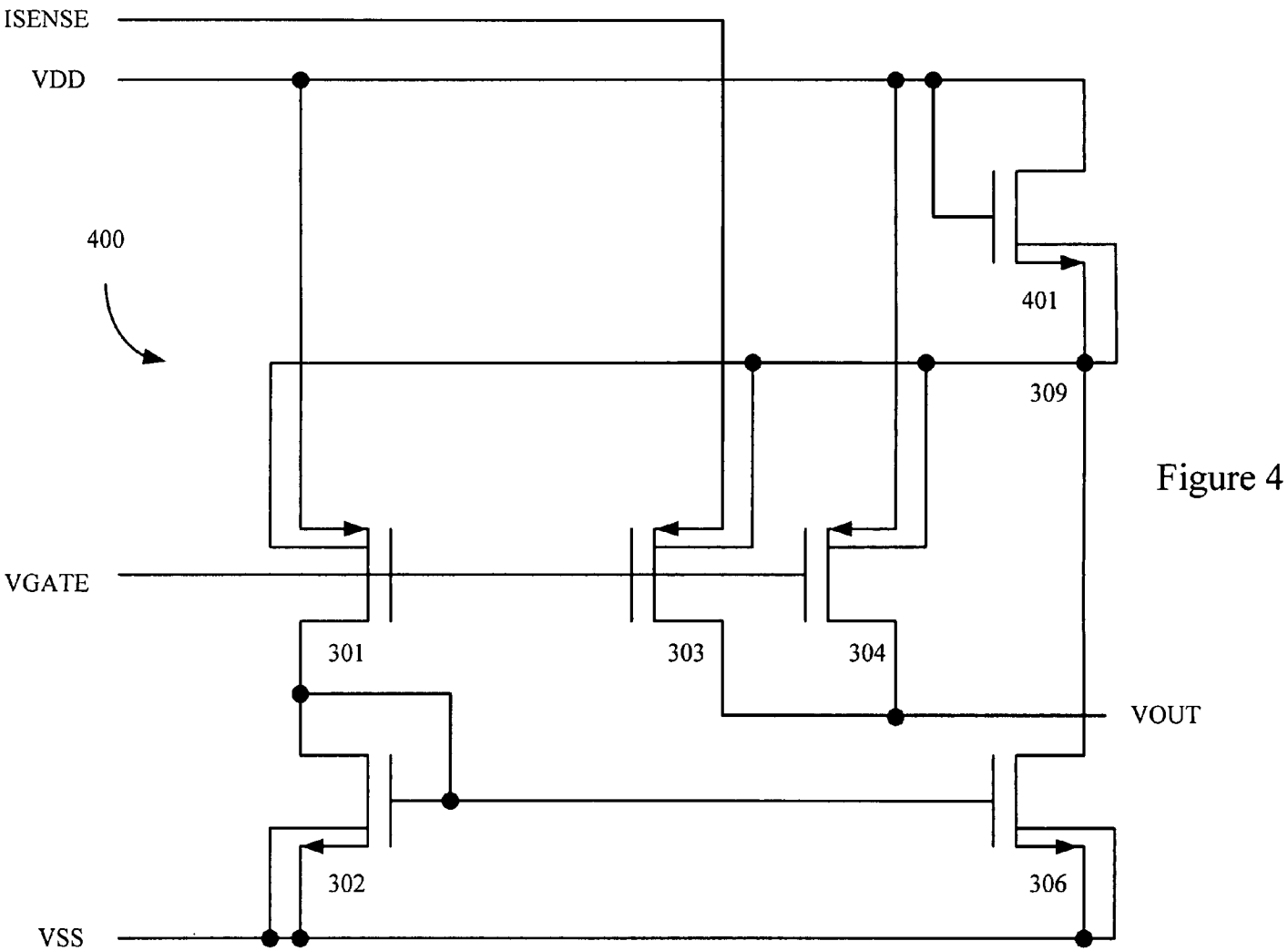

FIG. 4 illustrates another embodiment of a regulator output stage 400 including a triggering device 401. In this embodiment, triggering device 401 can be implemented using an NMOS transistor, wherein its gate and drain are connected to voltage source VDD and its source and body are connected to trigger node 309. (Note that elements having identical reference numerals have identical functionality and therefore their description is not repeated in reference to this figure or in subsequent figures.) In this configuration, the bias circuit comprising transistors 301, 302, and 306 can be used to ensure that the threshold voltage of triggering device 401 is between approximately 0.5 V and 0.7 V.

Note that in one embodiment, triggering device 401 can be implemented using a "substrate" (also called a "native") NMOS transistor. This substrate NMOS transistor, which has a predetermined concentration in the substrate (e.g. $3\times10^{14}$-$5\times10^{14}$ $cm^{-3}$ using Boron) (as described in "Physics of Semiconductor Devices, by S. M. Sze, page 32, Wiley-Interscience, $2^{nd}$ Edition, 1981), can have a threshold voltage of approximately 0.3 V to 0.5 V.

Figure 5:
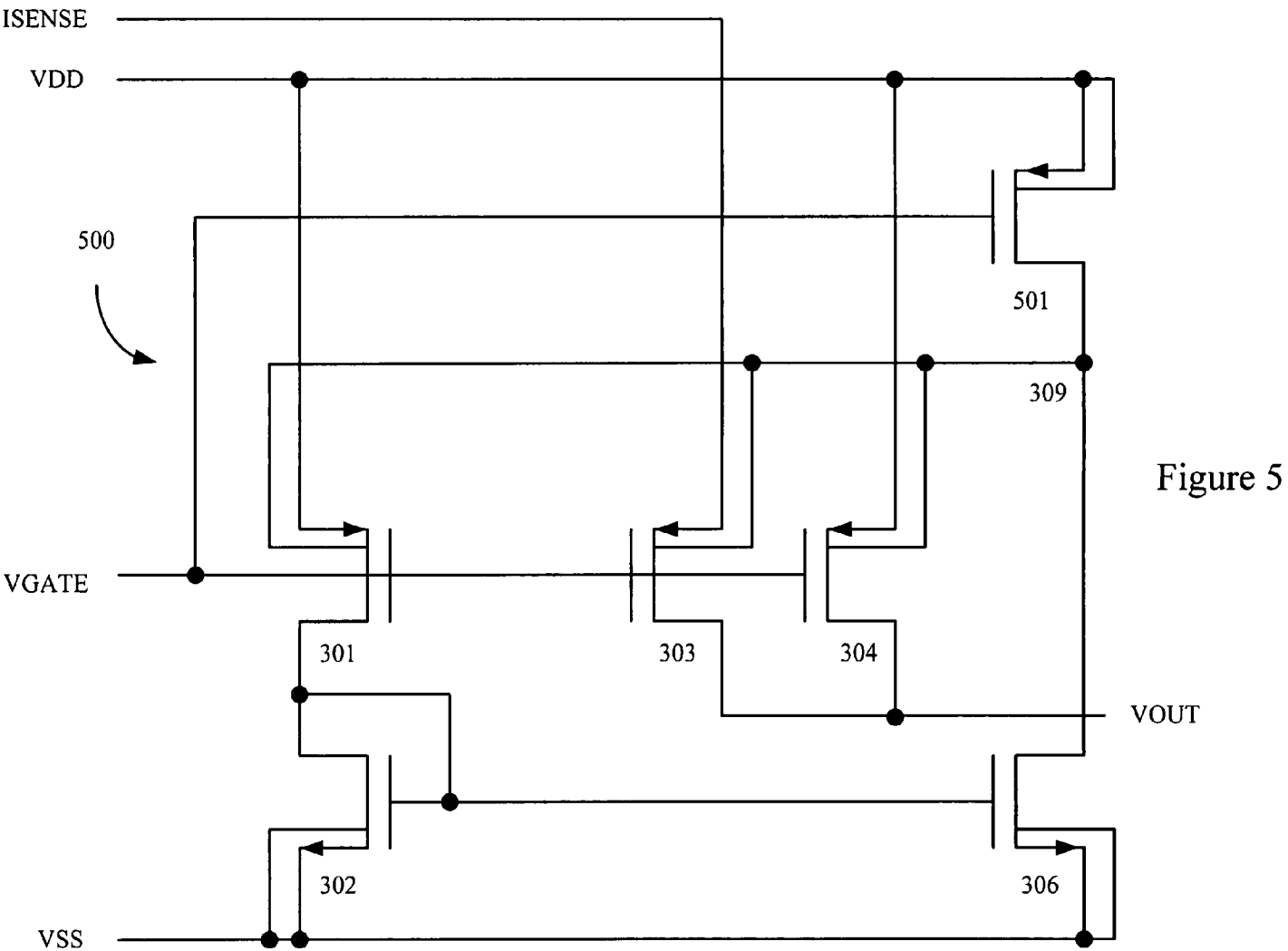

FIG. 5 illustrates another embodiment of a regulator output stage 500 including a triggering device 501. In this embodiment, triggering device 501 can be implemented using a PMOS transistor, wherein its source and body are connected to voltage source VDD and its drain is connected to trigger node 309. In this configuration, to turn on triggering device 501, its gate can receive VGATE (rather than being connected to VDD). Notably, like the previously described NMOS implementations, this PMOS implementation can advantageously provide a forward bias to the body to source junction of power device 304. Additionally, a PMOS implementation can provide a slightly smaller footprint than an NMOS implementation (e.g. on the order of 4-6μ). Yet further, because triggering device 501 and power device 304 can be formed using a similar fabrication process (i.e. a PMOS fabrication process), the characteristics of these devices (e.g. drift, threshold voltages, and/or other characteristics) can closely track each other.

Figure 6:
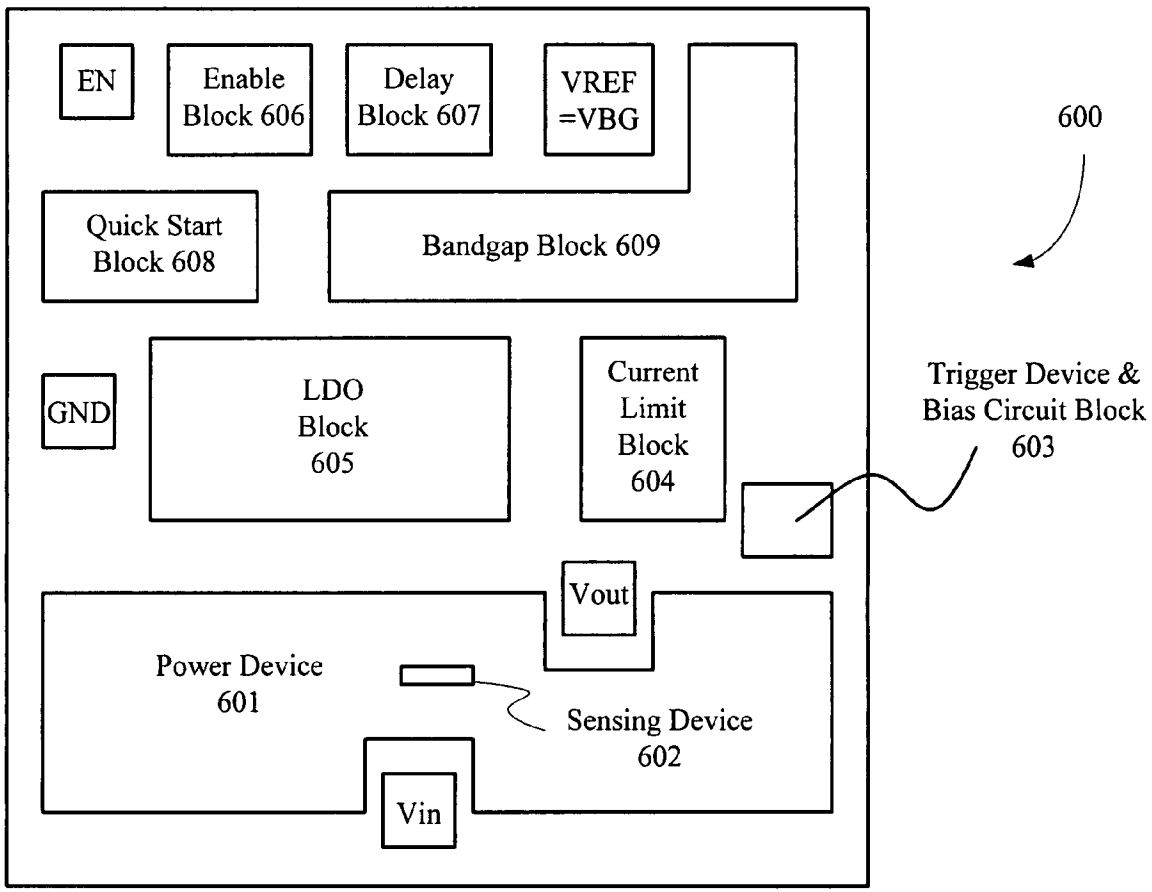
FIG. 6 illustrates an exemplary layout of an integrated circuit including a voltage regulator having an output stage in accordance with the present invention.

FIG. 6 illustrates an exemplary layout for an integrated circuit (IC) 600, wherein IC 600 includes an output stage for a voltage regulator in accordance with the present invention. In this embodiment, sensing device 602 can be implemented using a transistor from power device 601. A trigger device and bias circuit block 603 can be formed in close proximity to a current limit block 604 and power device 601. An error amplifier and other circuitry associated with the LDO regulator can be located in an LDO block 605.

In one embodiment, IC 600 can also include a quick-start block 608, an enable block 606, a delay block 607, and a bandgap block 609. Bandgap block 609 can include circuitry for providing a bandgap reference voltage VBG (i.e. VREF). Exemplary circuitry for bandgap block 609 is described in "A Simple Three Terminal IC Bandgap Reference" by A. P. Brokaw, in IEEE Journal of Solid State Circuits, vol. SC-9, pp. 388-393, December 1974, and U.S. Pat. No. 6,737,908, issued to Micrel, Inc. on May 18, 2004.

In this embodiment of IC 600, quick-start block 608 can be used to provide a pseudo bandgap voltage with appropriate filtering until bandgap block 609 is fully ramped up to the bandgap voltage. After bandgap block 609 can provide the desired voltage, quick-start block 608 can be bypassed. The voltage regulator can be enabled/disabled with the help of an enable block 606. Enable block 606 can also provide precise control of the enable/disable voltage. For example, in one embodiment, the voltage regulator can be enabled when the voltage is $\geqq$1 V and disabled when the voltage is $\leqq$0.7 V. A delay block 607 can be used to provide a controlled delay for the enable signal to synchronize with other signals in the circuit (e.g. bandgap voltage, thermal shutdown, etc.). Exemplary pins for voltage regulator IC 600 can include an enable pin EN, a ground pin GND (VSS), an input voltage Vin pin (VDD), a reference voltage Vref pin (e.g. signal Vref provided by bandgap block 609), and an output voltage Vout pin.

Figure 7:
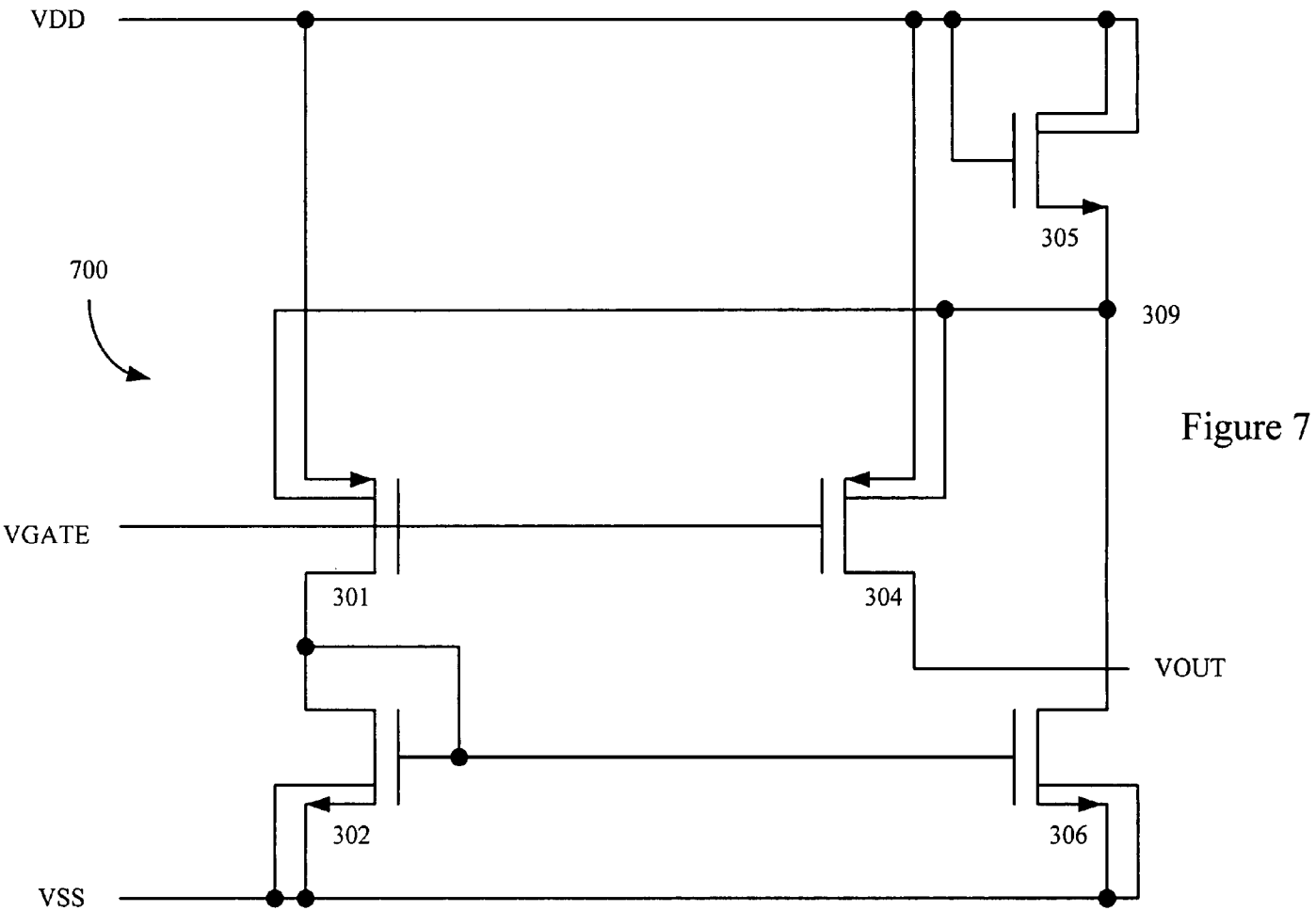
FIG. 7 illustrates an exemplary output stage that can function without a current limit circuit.

Although illustrative embodiments of the invention have been described in detail herein with reference to the accompanying figures, it is to be understood that the invention is not limited to those precise embodiments. They are not intended to be exhaustive or to limit the invention to the precise forms disclosed. As such, many modifications and variations will be apparent. For example, although an LDO regulator is discussed herein, the described output stage could be used with any voltage regulator or, more particularly, with any large power device for performance optimization. Moreover, although a current limit circuit is preferred for very small integrated circuits, other embodiments of an output stage can be implemented without a current limit circuit and thus its corresponding sense device. For example, FIG. 7 illustrates an exemplary output stage 700 that eliminates sense device 303 (see, for example, FIG. 3). Note that other embodiments of output stage 700 could include the MOSFET configurations described in reference to FIGS. 4 and 5. Accordingly, it is intended that the scope of the invention be defined by the following Claims and their equivalents.

The invention claimed is:

1. A voltage regulator output stage comprising:

a power device having a source connected to a first voltage source, a gate receiving a gate bias, and a drain connected to an output of the regulator output stage; and a sense device having a source connected to a node, a gate receiving the gate bias, and a drain connected to the output of the regulator output stage, wherein the node is connected to the first voltage source through a resistor and further connected to a current limit circuit, and wherein body to source junctions of the power device and the sense device are forward biased.

2. A voltage regulator output stage comprising:

a power device having a source connected to a first voltage source, a gate receiving a gate bias, and a drain connected to an output of the regulator output stage; and a sense device having a source connected to a node, a gate receiving the gate bias, and a drain connected to the output of the regulator output stage, wherein body to source junctions of the power device and the sense device are forward biased, wherein the node is connected to the first voltage source through a resistor and further connected to a current limit circuit, and wherein if a current limit condition occurs, then the gate bias is generated by the current limit circuit.

3. The voltage regulator output stage of claim 2, further including:

a triggering device connected between the first voltage source and the bodies of the power device and the sense device; and a bias circuit for setting the current through the triggering device, wherein the triggering device is an NMOS transistor having a drain, a gate, and a body connected to the first voltage source, and a source connected to the bodies of the power device and the sense device.

4. The voltage regulator output stage of claim 2, further including:

a triggering device connected between the first voltage source and the bodies of the power device and the sense device; and a bias circuit for setting the current through the triggering device, wherein the triggering device is an NMOS transistor having a drain and a gate connected to the first voltage source, and a source and a body connected to the bodies of the power device and the sense device.

5. The voltage regulator output stage of claim 4, wherein the NMOS transistor is a substrate NMOS transistor.

6. The voltage regulator output stage of claim 2, further including:

a triggering device connected between the first voltage source and the bodies of the power device and the sense device; and a bias circuit for setting the current through the triggering device, wherein the triggering device is a PMOS transistor having a source and a body connected to the first voltage source, a drain connected to the bodies of the power device and the sense device, and a gate for receiving the gate bias.

7. A regulator output stage comprising:

a first PMOS transistor having a gate connected to a gate bias line, a source connected to a first voltage source, and a drain connected to an output terminal;

a second PMOS transistor having a gate connected to the gate bias line, a source connected to a current sense line as well as to the first voltage source through a resistor, and a drain connected to the output terminal;

a third PMOS transistor having a gate connected to the gate bias line, a source connected to the first voltage source, and a drain;

a first NMOS transistor having a drain and a gate connected to the drain of the third PMOS transistor, and a source connected to a second voltage source;

a second NMOS transistor having a gate connected to the gate of the first NMOS transistor, a source connected to a second voltage source, and a drain; and a triggering transistor connected between the first voltage source and bodies of the first, second, and third PMOS transistors.

8. The regulator output stage of claim 7, wherein the triggering transistor is an NMOS transistor having a drain, a gate, and a body connected to the first voltage source, and a source connected to the bodies of the first, second, and third PMOS transistors.

9. The regulator output stage of claim 7, wherein the triggering transistor is an NMOS transistor having a drain and a gate connected to the first voltage source, and a source and a body connected to the bodies of the first, second, and third PMOS transistors.

10. The regulator output stage of claim 9, wherein the triggering transistor is a substrate NMOS transistor.

11. The regulator output stage of claim 7, wherein the triggering transistor is a PMOS transistor having a source and a body connected to the first voltage source, a source connected to the bodies of the first, second, and third PMOS transistors, and a gate connected to the gate bias line.

* * * * *